US007759298B2

(12) United States Patent
Dufresne et al.

(10) Patent No.: US 7,759,298 B2
(45) Date of Patent: Jul. 20, 2010

(54) THICKENED COMPOSITION AND METHOD FOR REMOVING ADHESIVE RESIDUE

(75) Inventors: Ralph E. Dufresne, Auburn, WA (US); James F. Kirchner, Renton, WA (US); David F. Feider, Renton, WA (US)

(73) Assignee: The Boeing Company, Chicago, IL (US)

( * ) Notice: Subject to any disclaimer, the term of this patent is extended or adjusted under 35 U.S.C. 154(b) by 818 days.

(21) Appl. No.: 11/610,579

(22) Filed: Dec. 14, 2006

(65) Prior Publication Data

US 2008/0146479 A1 Jun. 19, 2008

(51) Int. Cl.
*C11D 3/40* (2006.01)
*C11D 3/44* (2006.01)
*C11D 1/83* (2006.01)

(52) U.S. Cl. ..... 510/202; 510/200; 510/134; 510/407; 510/419; 510/432

(58) Field of Classification Search ..... 510/200, 510/202, 134, 407, 432, 419
See application file for complete search history.

(56) References Cited

U.S. PATENT DOCUMENTS

| | | | | |
|---|---|---|---|---|
| 4,324,595 | A | 4/1982 | Kasprzak | |
| 4,556,509 | A | 12/1985 | Demangeon et al. | |
| 4,617,251 | A | 10/1986 | Sizensky | |
| 4,650,822 | A | 3/1987 | Veazey et al. | |
| 4,732,695 | A | 3/1988 | Francisco | |
| 4,780,235 | A | 10/1988 | Jackson | |
| 4,905,371 | A | 3/1990 | Pai | |
| 5,015,506 | A | 5/1991 | Purcell | |
| 5,120,371 | A | 6/1992 | Bolden et al. | |
| 5,340,407 | A | 8/1994 | Bolden et al. | |
| 5,525,254 | A * | 6/1996 | Reininger | 510/200 |
| 5,698,044 | A | 12/1997 | Graham et al. | |
| 5,894,854 | A | 4/1999 | Miles | |
| 5,932,530 | A | 8/1999 | Radu et al. | |
| 5,952,277 | A | 9/1999 | Radu et al. | |
| 5,990,065 | A | 11/1999 | Vinson et al. | |
| 6,069,122 | A | 5/2000 | Vinson et al. | |
| 6,090,238 | A | 7/2000 | Smith | |
| 6,265,367 | B1 | 7/2001 | Callaghan et al. | |
| 6,884,316 | B2 | 4/2005 | Ono | |
| 6,923,873 | B2 | 8/2005 | Pageau et al. | |
| 7,112,652 | B2 | 9/2006 | Ford et al. | |
| 2003/0060380 | A1 * | 3/2003 | Ayarza et al. | 510/134 |
| 2007/0037717 | A1 * | 2/2007 | Clark et al. | 510/116 |

* cited by examiner

*Primary Examiner*—Charles I Boyer
(74) *Attorney, Agent, or Firm*—McNees Wallace & Nurick, LLC

(57) ABSTRACT

The present invention includes a process using environmentally benign materials for the removal of adhesive residues from hard substrates, particularly vehicles, e.g., cars, trucks, buses, aerospace vehicles including airplanes, and the like. The invention uses an absorbable indicator (tracer) dye to aid in detection of remaining residues that may be in need of additional cleaning. The process uses a novel adhesive remover composition comprising a non-halogenated organic solvent, a non-abrasive thickening agent, a surfactant, glycerine, and an absorbable indicator dye. The invention provides a cost effective, safe, environmentally friendly adhesive remover composition specifically formulated for removal of, e.g., pressure sensitive adhesive residues from large areas of aircraft composite and aluminum surfaces, as well as others.

19 Claims, 4 Drawing Sheets

THICKENED COMPOSITION AND METHOD FOR REMOVING ADHESIVE RESIDUE

CROSS REFERENCE TO RELATED APPLICATION

This application is related to application Ser. No. 11/610,622, filed Dec. 14, 2006, entitled "GELLED ADHESIVE REMOVER COMPOSITION AND METHOD OF USE," filed concurrently herewith and incorporated herein by reference in its entirety.

FIELD OF THE INVENTION

The present includes a process using environmentally friendly materials for the removal of adhesive residues from hard substrates, particularly vehicles, e.g., cars, trucks, buses, aerospace vehicles including airplanes, and the like. The invention uses an absorbable indicator (tracer) dye to aid in detection of remaining residues that may be in need of additional cleaning. The process uses a novel adhesive remover composition comprising a non-halogenated organic solvent, a non-abrasive thickening agent, a surfactant, glycerine, and an absorbable indicator dye. The invention provides a cost effective, safe, environmentally friendly adhesive remover composition specifically formulated for removal of, e.g., pressure sensitive adhesive residues from large areas of aircraft composite and aluminum surfaces, as well as others.

BACKGROUND OF THE INVENTION

Conventional methods for removing adhesive residues, e.g., associated with the removal of vinyl decals from hard surfaces, e.g., auto, truck, bus, railroad, marine, aircraft bodies, and the like, are often time consuming, expensive, inefficient, and require the use of environmentally hazardous materials. For example, using art-recognized techniques, vinyl decals are often removed by careful application of heat via a heat gun and scraping to remove most of the decal and adhesive. A typical method of removing remaining adhesive residue is to wipe it away with a solvent-soaked rag. This method may be acceptable for cleaning small areas, but it is impractical for cleaning large areas, such as an airplane wing. Furthermore, many commercially available adhesive remover compositions contain chlorinated organic solvents such as methylene chloride or carbon tetrachloride (a CFC known to damage stratospheric ozone), or they are alkaline, containing high quantities of potassium or sodium hydroxide. Such adhesive remover compositions are undesirable for large-scale industrial use.

Recently, citrus-based solvents such as D-limonene, which is typically obtained from orange peels, have been developed, but such adhesive remover compositions are ineffective and impractical for large-scale use in industrial settings, and they frequently require multiple treatments in order to remove all adhesive residues. Additional commercial products exist that purport to be useful for removing labels, gum, masking tape, and the like from nonabsorbent surfaces. While such products may be free of halogenated organic solvents, they are nevertheless liquids, and therefore their use is limited to small-scale applications in which the liquid can be contained.

The removal of adhesive residue from the exterior surfaces of airplanes, which may be made of composite materials, present special technical problems. For example, it would be impractical to apply liquids to the underside of an airplane wing (having surface areas of up to 2000 $ft^2$ or greater) because dripping liquid would contaminate the work area.

Large volumes of free-flowing (i.e., liquid) organic solvents are undesirable because of the risk of fire or environmental contamination, protection of personnel, and the need for hazardous waste disposal. Adhesive residue removing compositions for use on the exterior surfaces of airplanes should not cause mechanical damage to adjacent or underlying structures and finishes. In addition, chemical attack or degradation of adjacent or underlying substrates and finishes including primer coatings should not occur. In order to be practical, any method of removing adhesive residues should ideally conclude with a water-based wash step, such as washing with soap and water. Furthermore, an adhesive removal method should be applicable and practical for horizontal, vertical, and overhead surfaces. The extensive use of carbon composite materials on new airplanes imposes heretofore unknown restrictions on chemical cleaning materials. Most of the cleaners, strippers, and other materials used on conventional aluminum aircraft surfaces are not compatible with composite materials.

There is no known, cost effective, environmentally compatible, or practical method or material for accomplishing removal of adhesive residues from large composite aircraft surfaces on the scale now required. There exists a need for a fast, safe, and effective process for removing adhesive residue remaining after removal a decal, appliqué, tape, etc.

SUMMARY OF THE INVENTION

The present invention includes a process using environmentally friendly materials for the removal of adhesive residues from hard substrates, particularly vehicles, e.g., cars, trucks, buses, aerospace vehicles including airplanes, and the like. The invention uses an absorbable indicator (tracer) dye to aid in detection of remaining residues that may be in need of additional cleaning. The process uses a novel adhesive remover composition comprising a non-halogenated organic solvent, a non-abrasive thickening agent, a surfactant, glycerine, and an absorbable indicator dye. The invention provides a cost effective, safe, environmentally friendly adhesive remover composition specifically formulated for removal of, e.g., pressure sensitive adhesive residues from large areas of aircraft composite and aluminum surfaces, as well as others.

The present invention overcomes the above-noted deficiencies of known methods and materials, and it provides for the reduced use of large volumes of organic solvents; limited mechanical damage to adjacent or underlying structures and finishes, especially when used to remove adhesive residues from airplane surfaces; limited chemical attack or degradation of adjacent or underlying substrates and finishes including primers; compatibility with a final optional water-based wash step (e.g., with soap and water) or washing with any other acceptable cleaning solution; and suitability for use on horizontal, vertical, and overhead surfaces.

In an exemplary embodiment, the invention provides a method for removing adhesive residue from a substrate, including the steps of providing an adhesive remover composition comprising a non-halogenated organic solvent, a non-abrasive thickening agent, a surfactant, glycerine, and an absorbable indicator dye; applying the adhesive remover composition to a substrate that has an adhesive residue adhering thereto; waiting for a sufficient amount of time to lapse during which the absorbable indicator dye absorbs into (or onto) the adhesive residue; removing the adhesive remover composition to produce a cleaned substrate; and inspecting the cleaned substrate for the presence of the absorbable indicator dye.

The amount of time during which the adhesive remover composition is in contact with the substrate depends on the nature of the adhesive residue, the relative amount and identity of the solvent, and the like. The length of time should be sufficient to permit the solvent to soften the adhesive residue. Suitable times include but are not limited to 10 minutes, 20 minutes, 30 minutes, or longer, but not so long that the adhesive remover composition becomes substantially dry. Generally, the greater the amount of glycerine in an adhesive remover composition of the invention, the lower the effective vapor pressure of the solvent, and greater amounts of glycerine therefore permit longer incubation periods.

The invention also relates to a novel adhesive remover composition. An adhesive remover composition of the invention may have viscosity and handling characteristics adapted for mechanized application to horizontal, vertical, and overhead surfaces, such as are encountered in major aircraft maintenance. In preferred embodiments of the invention, an adhesive remover composition effectively removes adhesive residue with minimal substrate damage or complications to nearby surfaces or equipment. An absorbable indicator (tracer) dye within the adhesive remover composition permits rapid visual evaluation of process effectiveness. Other features of the invention include an adhesive remover composition having improved flammability, explosion, and health characteristics. In another aspect, an adhesive remover composition of the invention may be compatible with common waste treatment and disposal methods.

The methods and adhesive remover compositions of the present invention overcome prior art deficiencies. Other features and advantages of the present invention will be apparent from the following more detailed description of preferred embodiments, taken in conjunction with the accompanying drawings, which illustrate, by way of example, the principles of the invention.

DETAILED DESCRIPTION OF THE INVENTION

Figure 1:
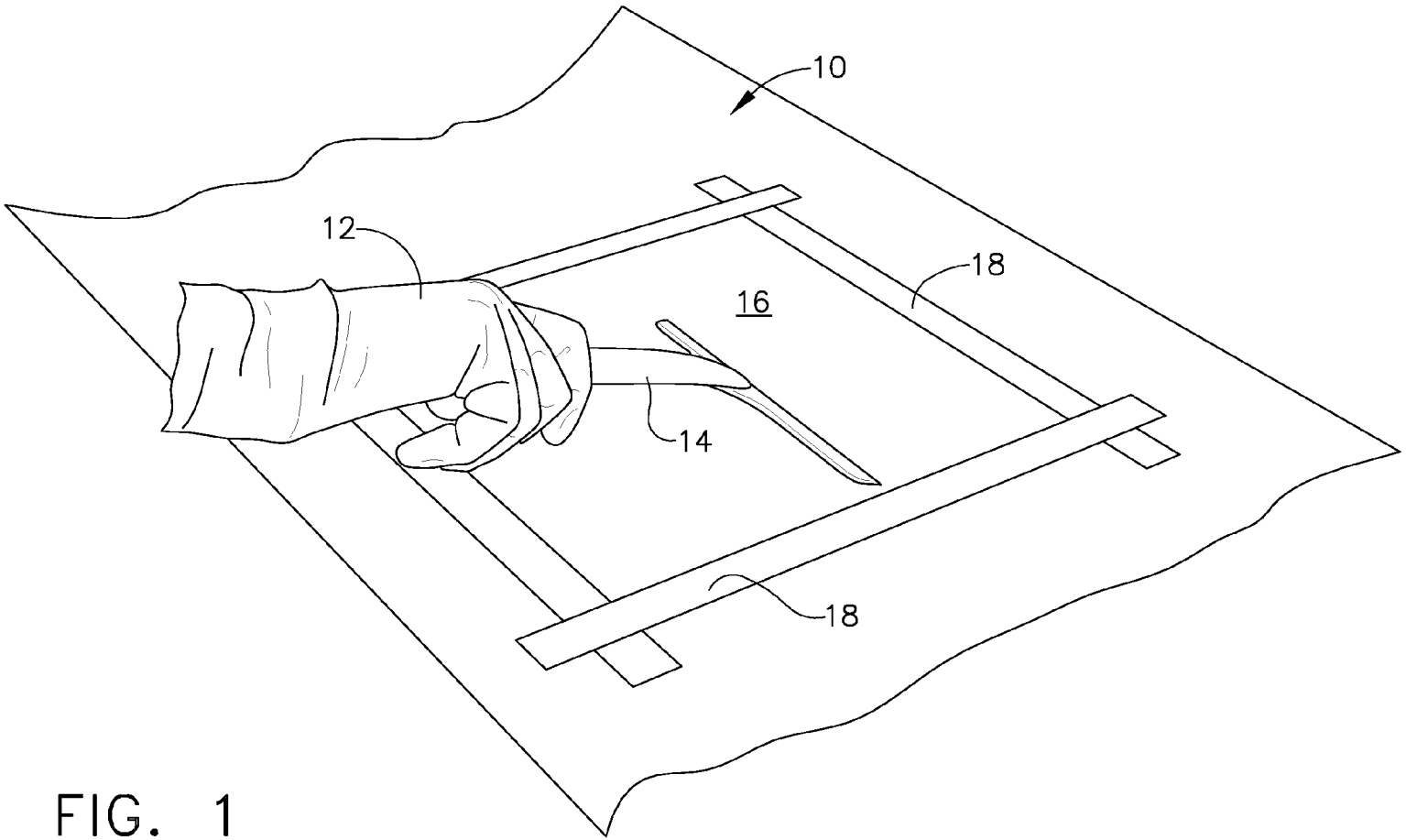
FIGS. 1-4 depict steps of an example method of removing adhesive residue according to the invention.

Referring to the accompanying drawings, in FIG. 1 a sample substrate having an adhesive residue adhering thereto is fixed to a workbench (10) by tape (18) and then a thin coat (about 1 cm thickness) of adhesive remover composition (16) is applied by hand (12) using an applicator tool (14). For example, the substrate, which may be aluminum or graphite epoxy composite, may previously have had a decal that was removed by scoring it into strips, heating it with heat gun, and then peel strips away from the substrate.

Figure 2:
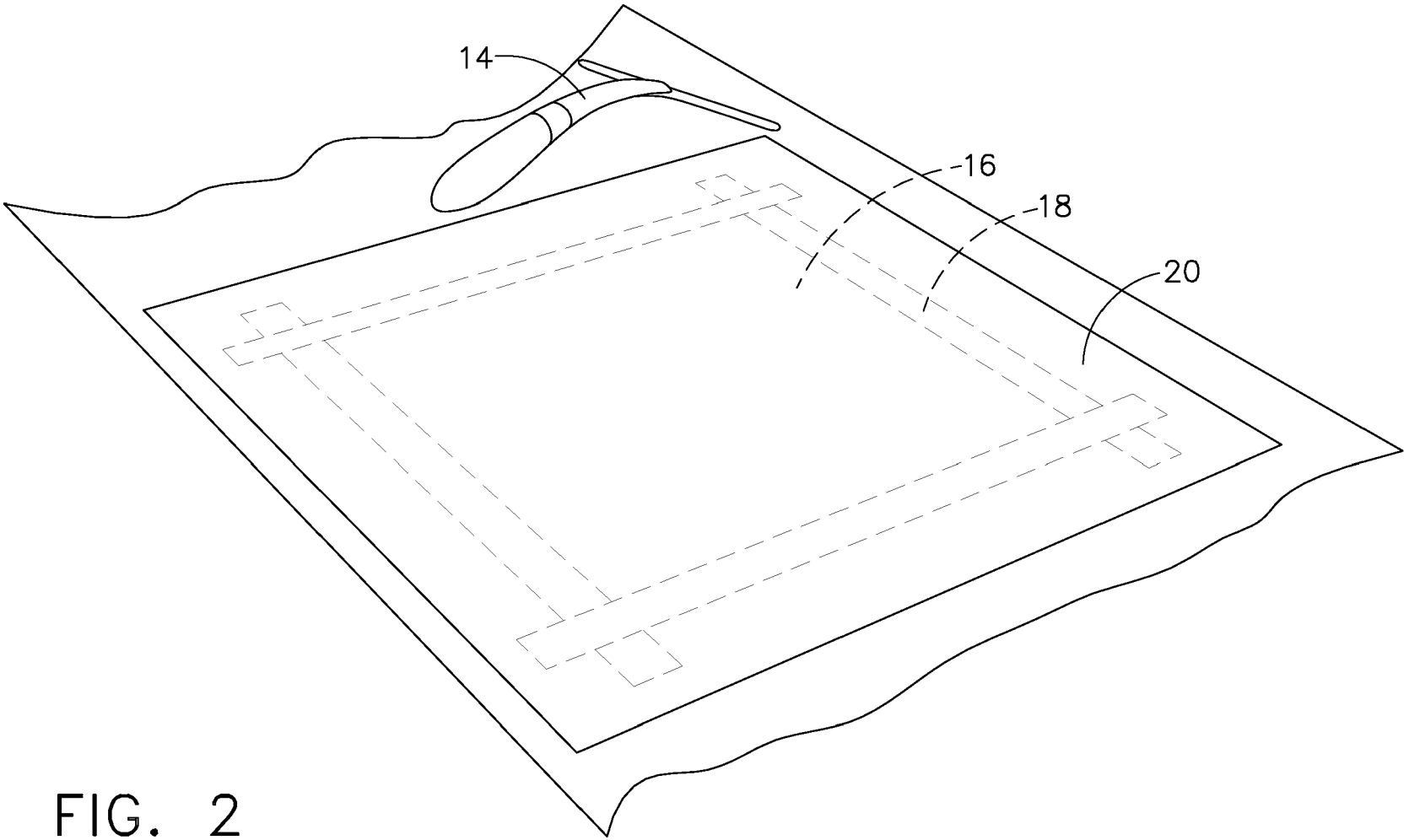

FIG. 2 depicts a subsequent step, in which an optional drop cloth (20) is laid down over the coated sample substrate, and approximately twenty minutes is permitted to lapse to facilitate infiltration of the adhesive remover composition (16) into the adhesive residue. The optional drop cloth (20) may prevent excessive or premature drying of the adhesive remover composition (16).

Figure 3:
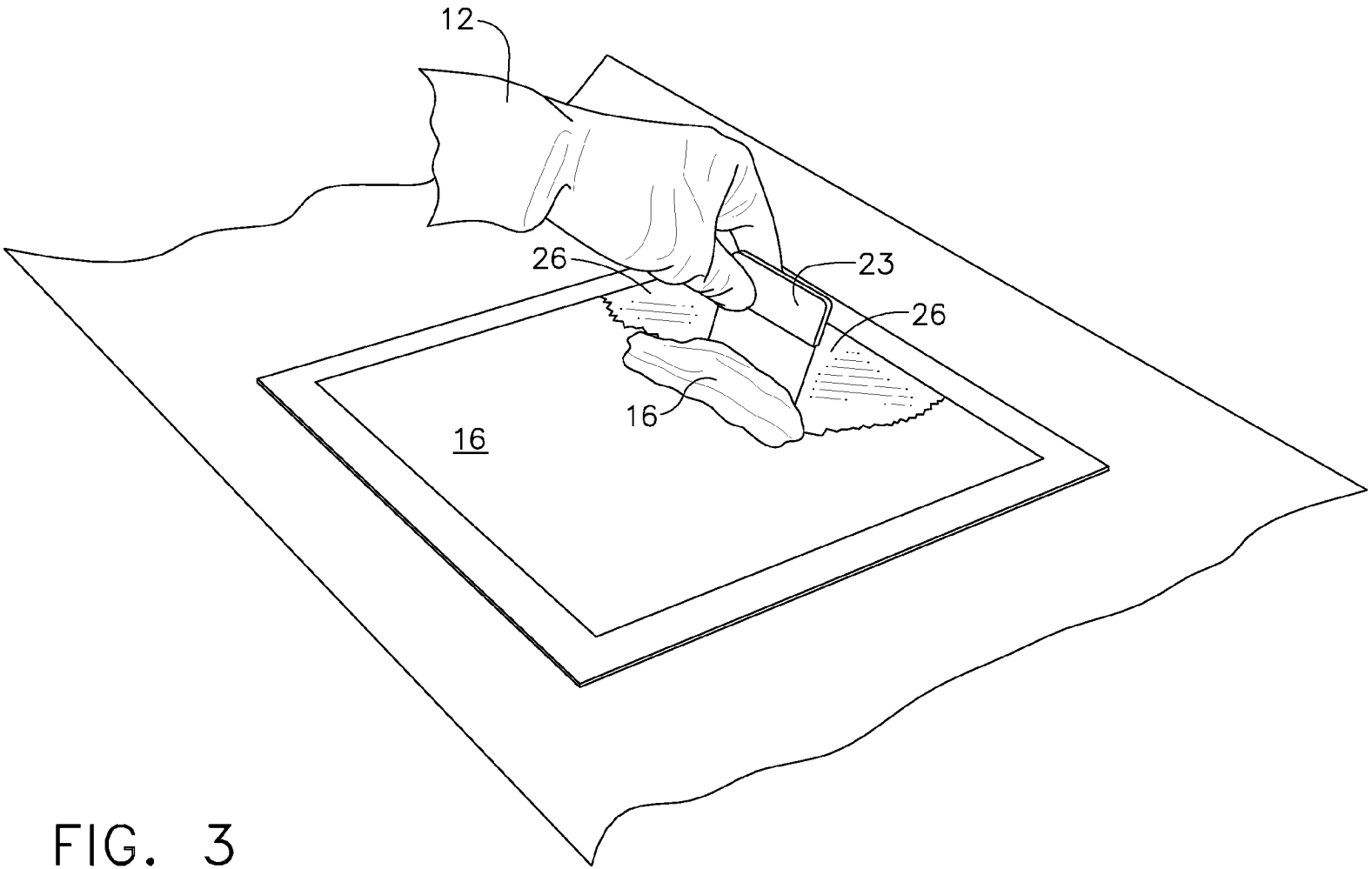

FIG. 3 depicts an additional step, in which the adhesive remover composition (16) is scraped off the substrate by hand (12) using a scraping tool (23) to reveal a cleaned substrate (26), which is substantially free of adhesive residue.

Figure 4:
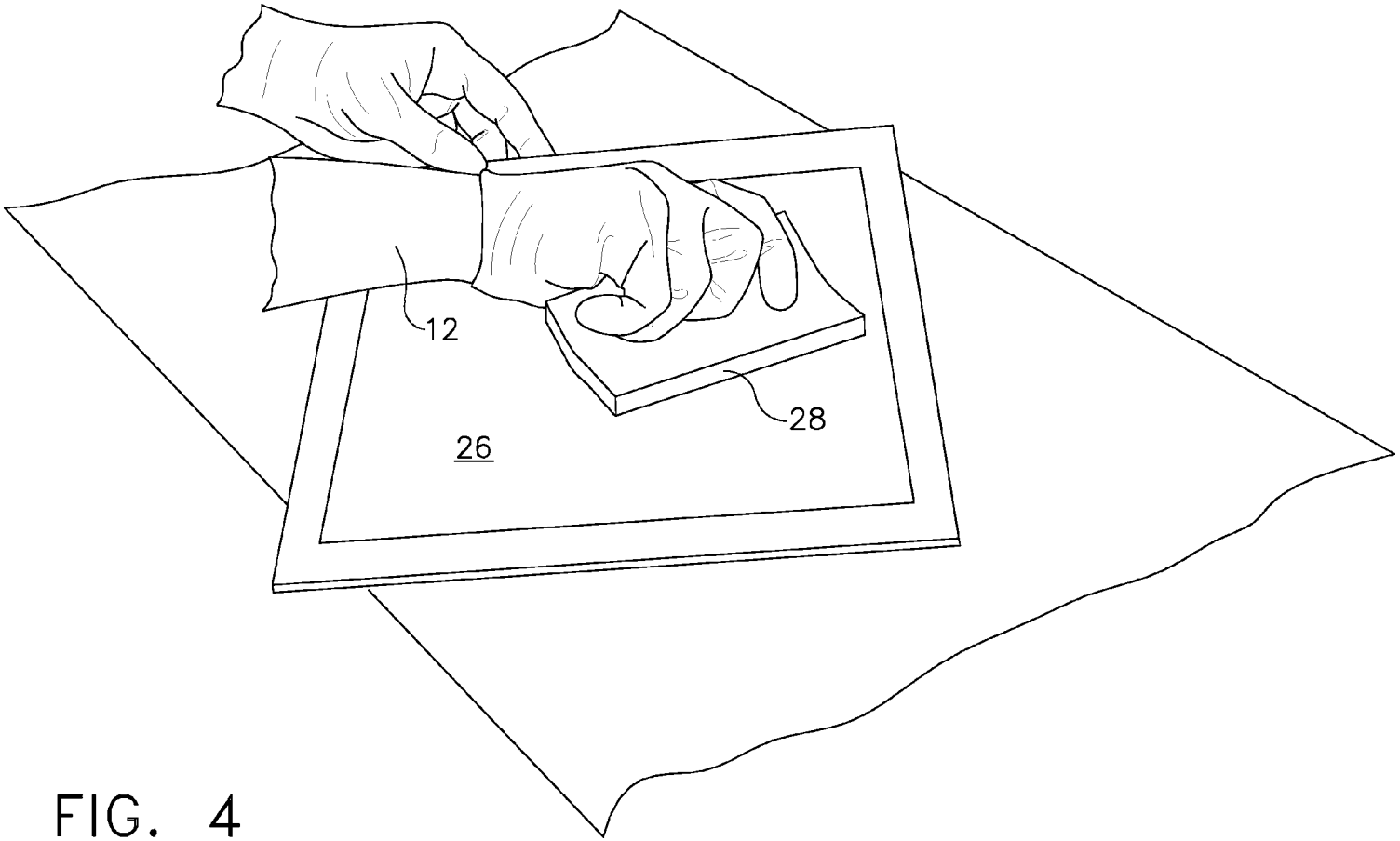

FIG. 4 depicts a final step of removing adhesive residue according to the invention, in which a cleaned substrate (26) is cleaned with a non-abrasive (e.g., nylon) scrubbing pad (28) using an aqueous solution of liquid (hand) dish washing detergent and tap water.

An adhesive is any substance that is capable of bonding other substances or components together by surface attachment. Adhesives typically comprise low molecular mass plasticizers, glues, binding agents, and other such materials, which may include a polymer, copolymer, or a combination thereof, which are essentially responsible for the mechanical, adhesive, and cohesive properties. When such adhesives are removed from various surfaces, especially after long-term use, they often leave behind marks, discolorations, and debris (e.g., adhesive residue). Although many adhesives do not cause mechanical destruction of the substrate at the time of fastening or of detachment, they nevertheless leave the fastening site in an unsightly or unusable state.

Several types of adhesives exist, including drying adhesives, contact adhesives, hot adhesives, reactive adhesives, and pressure sensitive adhesives. Drying adhesives, e.g., glues such as white glue and rubber cements, are typically a mixture of ingredients, usually polymers, dissolved in a solvent; as the solvent evaporates, the adhesive hardens. Contact adhesives must be applied to both surfaces and allowed to dry before the two surfaces are pushed together; but once the surfaces are pushed together the adhesive bond forms very quickly, and it is usually not necessary to apply pressure. Hot adhesives, also known as thermoplastic adhesives or hot melt adhesives, are thermoplastics that are applied hot, e.g., with a glue gun, and simply allowed to harden as they cool. Reactive adhesives work by chemical bonding with the surface material, and they are applied in thin films, which are less effective when there is a secondary goal of filling gaps between the surfaces. Reactive adhesives include two-part epoxy and isocyanate adhesives.

Pressure sensitive adhesives, e.g., acrylic, silicone, and natural and synthetic rubber, as well as combinations thereof, form a bond by the application of light pressure to join components. The bond forms because the adhesive is soft enough to conform to the microscopic surface features of the substrate. The bond has strength because the adhesive is hard enough to resist flow when stress is applied to the bond. Once the adhesive and the joined components are in close proximity, molecular interactions such as van der Waals forces produce a strong union. Pressure sensitive adhesives may be used for permanent and removable applications. Some high performance permanent pressure sensitive adhesives exhibit high adhesion values and can bond kilograms of weight per square centimeter of contact area, even at elevated temperature. Permanent pressure sensitive adhesives may be initially removable and build adhesion to a permanent bond after several hours or days. Some removable adhesives are designed to repeatedly stick and unstuck, and they have low adhesion and generally can not support much weight. Pressure sensitive adhesives may be low viscosity polymers that are coated and then reacted with radiation to increase molecular weight and form the adhesive; or they may be high viscosity materials that are heated to reduce viscosity enough to allow coating, and then cooled to their final state.

An example embodiment of the invention includes a multistep process for removing an adhesive residue, especially a pressure sensitive adhesive residue, from a substrate comprising the steps of providing an adhesive remover composition comprising a non-halogenated organic solvent, a non-abrasive thickening agent, a surfactant, glycerine, and an absorbable indicator dye; applying the adhesive remover composition to a substrate that has an adhesive residue adhering thereto. A sufficient amount of time is permitted to lapse during which the absorbable indicator dye absorbs into, or adsorbs onto (which is used interchangeably herein), the adhesive residue. The adhesive remover composition is removed to produce a cleaned substrate, and the cleaned substrate is inspected for the presence of the absorbable indicator dye. The method may also include the step of washing the cleaned substrate with an aqueous solution, such as tap water and liquid dish washing detergent or any other solvent or cleaning solution. In, e.g., arid regions of the world where use of an aqueous solution is not practical, a non-aqueous solution such as a non-halogenated organic solvent may be used. Adhesive residues incorporated into the adhesive remover composition may not flush with water, and therefore after application they should be scraped off, along with incorporated residue, and then disposed as solvent-containing waste.

The invention also relates to an adhesive remover composition comprising a non-abrasive thickening agent, a surfactant, glycerine, and an absorbable indicator dye. When such an adhesive remover composition is provided in a solvent-free or concentrated form, it may be reconstituted with a non-halogenated organic solvent prior to use.

The non-halogenated organic solvent is believed to decrease the viscosity of the material and to dissolve into the adhesive residue and thereby soften it and enable its subsequent removal. The non-halogenated organic solvent may be any suitable non-halogenated solvent, including, but not limited to a low molecular weight alkyl alcohol, a low molecular weight alkyl ketone, or a combination thereof. Preferred non-halogenated organic solvents dissolve into polymeric components of the adhesive residue and therefore cause it to soften or swell. Examples of low molecular weight alkyl alcohols include $C_1$-$C_6$ alcohols, such as ethanol or isopropanol, and example low molecular weight alkyl ketones include $C_3$-$C_8$ ketones, such as methyl propyl ketone or acetone. Additional solvents, e.g., 2-butoxyethanol or diethylene glycol, may be present in an adhesive remover composition of the invention. In preferred embodiments, the adhesive remover composition is essentially free (e.g., less than 1% by weight, or less than 0.1% by weight, or even about 0% by weight) of halogenated organic solvents, such as methylene chloride, chloroform, and carbon tetrachloride (or other chlorinated hydrocarbons); and the adhesive remover composition is readily dispersible in water. The addition of glycerine to an adhesive remover composition is believed to reduce the vapor pressure of the non-halogenated organic solvent and therefore to increase the drying time so that sufficient time may lapse during which the solvent softens the adhesive residue.

The thickening agent of an adhesive remover composition of the invention may be any inert colloidal solid material that disperses completely in water, such as fumed silica, cellulose, or a cellulose derivative, e.g., cellulose ethers, such as hydroxypropyl methyl cellulose, hydroxypropyl ether cellulose, hydroxymethyl cellulose, or a combination thereof. Preferred thickening agents are non-abrasive, i.e., adhesive remover compositions of the invention preferably do not cause the substrate to be scratched or marred when used according to the methods described herein.

The surfactant of an adhesive remover composition of the invention may be a combination of anionic surfactants (e.g., sodium dodecyl sulfate, ammonium lauryl sulfate, and sodium laureth sulfate) and nonionic surfactants (e.g., octyl glucoside, decyl maltoside, cetyl alcohol, and oleyl alcohol), such as those commonly found in liquid (hand) dish washing detergent. See, e.g., U.S. Pat. Nos. 4,556,509, 5,990,065, and 6,069,122, all of which are incorporated herein by reference.

For example, suitable anionic detergents include $C_8$-$C_{18}$ alkyl sulfates, sulfonates, and carboxylates, especially alkyl sulfates containing 10-16 carbons in the alkyl group; $C_9$-$C_{15}$ alkylbenzene sulfonates wherein the alkyl group is either a straight chain or a branched chain, such as sodium dodecylbenzene sulfonate; $C_8$-$C_{22}$ olefin sulfonates, especially olefin sulfonates containing from 12-22 carbon atoms in the alkenyl group such as $C_{14-17}$ olefin sulfonate; $C_8$-$C_{18}$ alkyl ether ethylenoxy sulfates of the formula $R(OC_2H_4)_nOSO_3M$, wherein n is 1-12 and preferably 1-6, R is an alkyl group containing 8-18 carbon atoms and preferably 10-16 carbons, and M is a cation, preferably sodium or ammonium, such as ammonium lauryl triethenoxy ether sulfate; $C_{10}$-$C_{20}$ paraffin sulfonates especially alkane sulfonates containing 14-17 carbon atoms in the alkyl group, such as sodium $C_{14-17}$ paraffin sulfonate; $C_6$-$C_{12}$ phenyl ether polyethylenoxy sulfates, especially sulfonates having 8-12 carbons in the alkyl group, such as ammonium nonylphenyl tetraethenoxy ether sulfate; $C_8$-$C_{12}$ alkyl sulfonacetates corresponding to the formula $RO_2CH_2SO_3M$, wherein R is a $C_8$-$C_{18}$ alkyl especially sulfoacetates containing 12-16 carbon atoms in the alkyl group; N-mono-$C_8$-$C_{22}$ alkyl or alkenyl, including alkyl or alkenyl groups interrupted by an ether or amido group, sulfosuccinates, including disodium N-mono-$C_8$-$C_{18}$ acylisopropanolamidnosulfosuccinate, disodium lauryl sulfosuccinate, and N-monooleylisopropanolamidosulfosuccinate; N—$C_8$-$C_{18}$ acyl taurines, especially taurates containing 12-14 carbon atoms in an acyl group; and O—$C_8$-$C_{18}$ acyl isethionates, especially isethionates containing 12-14 carbon atoms in an acyl group.

Example nonionic surfactants include the ethoxylated fatty alcohols having 8-18 carbon atoms; ethoxylated alkylphenols having 6-12 carbons in the alkyl group; ethoxylated fatty alkanolamides having the structure $R^1CONR^2R^3(EtO)_x$, wherein $R^1CO$ is an acyl group containing 6-18 carbon atoms, $R^2$ is an H, $CH_3$, or $CH_2CH_2OH$ group, $R^3$ is a $CH_3$, $CH_2CH_2OH$, or a $CH_2CHOHCH_3$ group, and x is an integer from 0-20; and ethoxylated lanolin derivatives and ethoxylated sorbitans, including fatty acid esters of sorbitol having 10-18 carbon atoms in the fatty acid group. Other suitable nonionic detergents are the trialkyl polar amine oxides having the formula $R^1R^2R^3N{\rightarrow}O$ wherein $R^1$ is a $C_8$-$C_{18}$ alkyl, alkenyl, or hydroxy alkyl group and $R^2$ and $R^3$ are each methyl, ethyl, propyl, ethanol, or propanol or $R^2$ and $R^3$ are joined together with the nitrogen atom to form a morpholino group, such as lauric-myristic monoethanolamide, lauric-myristic diethanolamide, and lauryl dimethyl amine oxide.

The absorbable indicator dye of an adhesive remover composition, examples of which include methylene blue and food coloring, is absorbed into an adhesive residue when used in a method of the invention. An absorbable indicator dye should be soluble in the solvent components of the adhesive remover composition, and the dye should be absorbed into (or adsorbed onto) the adhesive residue that is being removed so that it can function as an indicator for completeness of residue removal. When an adhesive remover composition is removed from a substrate in accordance with the methods described herein, the presence of any dye on the substrate indicates that all adhesive residues have not been completely removed, and therefore the method should be repeated.

Many absorbable organic and organometallic indicator dyes, especially blue-colored dyes, are useful for general applications, i.e., where the substrate is not blue. The dye is observable indicator of remaining adhesive residue when there exists a color contrast between the substrate and the absorbed dye. In a typical embodiment, the other components of an adhesive remover composition are white or colorless. The indicator dye may therefore be customized for the unique requirements of specific applications. Several useful dyes of various colors are commercially available from Eager Plastics, Inc. (Chicago, Ill.), including "Hi-Bright Red," "Ruby Red," "Old Rose," "Scarlet Red,""Shocking Pink," "Magenta," "Violet," "Bright Purple," "Bright Orange," "Honey Brown," "Light Brown," "Brilliant Blue," "Royal Blue," "Turquoise," "Kelly Green,""Lime Green," "Fluorescent Yellow," "Lemon Yellow," "Fluorescent Lime," "Avocado Green," and "Aztec Gold." Further example absorbable indicator dyes include food coloring, such as brilliant blue FCF (FD&C Blue No. 1), indigotine (FD&C Blue No. 2), fast green FCF (FD&C Green No. 3), allura red AC (FD&C Red No. 40), erythrosine (FD&C Red No. 3), tartrazine (FD&C Yellow No. 5), and sunset yellow FCF (FD&C Yellow No. 6). Other examples of absorbable indicator dyes may be found in the U.S. Food and Drug Administration's list of substances Generally Recognized As Safe ("GRAS"), the Food Additive Status List, and the Color Additive Status List.

The relative quantities of the components of an adhesive remover composition of the invention are selected so that the composition is efficacious in the methods described herein. For use in large-scale industrial applications, the relative amounts of the components may be selected in order to produce a composition having a viscosity of about 500 to about 1000 poise (e.g., 600 or 700 poise), in which case it may be readily applied to a large substrate such as the underside of an airplane wing using an airless paint gun. In such applications, the adhesive remover composition should have sufficiently high viscosity to cling to overhead or vertical surfaces but thin enough for spray application with an airless pump. The amount of glycerine is ideally high enough to reduce the vapor pressure of the composition so that it does not dry before adhesive residues have been softened. Generally, only a small quantity of absorbable indicator dye is necessary, e.g., less than 1% by weight, or even less than 0.1% by weight.

Further components of an adhesive remover composition of the invention may include additives, such as pH modulating (i.e., buffering) agents; metal complexing (i.e., chelating) agents, such as EDTA or DTPA; emulsifiers; perfumes; and the like.

In an advantageous embodiment of the invention, a 5% by weight suspension of an adhesive remover composition in water has a pH of about 6 to about 8, or between about 6 and about 7. In preferred embodiments, a 5% by weight suspension of an adhesive remover composition in water has a pH essentially the same as the pH of tap water.

In the methods of the invention the substrate to which an adhesive remover composition is applied may be any hard, smooth surface that has an adhesive residue on it, especially a pressure sensitive adhesive used to adhere decals or appliqués on vehicles, e.g., cars, trucks, buses, and aerospace vehicles including airplanes. Additional examples of pressure sensitive adhesive applications include safety labels for power equipment, foil tape for HVAC duct work, automotive interior trim assembly, and sound/vibration damping films. Still further example applications include residues from carpet and wallpaper.

In an advantageous embodiment, the substrate is an epoxy graphite composite material, such as the exterior surface of an aerospace vehicle. Such aerospace applications also include the maintenance and service of appliqué systems, including an airplane appliqué lightning protection system that uses layers of flexible fluorocarbon sheet material applied to critical wing areas with pressure sensitive adhesives. Whereas tape is usually intended for short-term use where a medium adhesive bond is complimentary with ease of removal. But an appliqué is often intended as a permanent part of an aircraft, and it must have very strong adhesive bonds, with ease of removal being a secondary concern. During the operational life of the aircraft, an appliqué system may have to be partially or totally removed and re-installed. Removal of appliqué sheets leaves large quantities of adhesive residues over large surface areas of the primed composite surface. These residues must be removed, prior to re-installation of an appliqué system by an efficient, ergonomic, environmentally friendly, and cost effective process that does not damage the aircraft. The present invention provides a gel or paste adhesive remover composition that does not damage, attack, or degrade primers, paints, sealants, aluminum, or other materials of an airplane.

EXAMPLES

Example 1—Example Adhesive Remover Composition

The following components were mixed to produce an adhesive remover composition having a pH=7.6 (5% in water) and viscosity ≈700 poise:

| COMPONENT | RELATIVE AMOUNT (by weight) |
|---|---|
| isopropyl alcohol | <75% |
| silica, amorphous | 5-10% |
| glycerine | <10% |
| methylpropyl ketone | <20% |
| absorbable indicator dye | <1% |
| other ingredients, including surfactant | <8.5% |

Example 2—Example Adhesive Remover Composition

The following components may be mixed to produce an adhesive remover composition:

| COMPONENT | RELATIVE AMOUNT (by weight) |
|---|---|
| Food Coloring | 0-.1 |
| Methylene Blue Chloride | 0-.1 |
| D-Limonene | 0-1.5 |
| Triethanolamine | 0-5 |
| Bentonite | 0-7 |
| Cellulose | 0-7 |
| Butyl Cellosolve | 0-10 |
| Stearic Acid | 0-10 |
| Talc | 0-10 |
| 8-Hydroxyquinoline | 0-.1 |
| Sodium Hydroxide | 0-.1 |
| Potassium Phosphate | 0-.1 |
| Dimethyl Glutarate | 0-5 |
| Dimethyl Adipate | 0-5 |
| Blue Food Color | 0-.1 |
| Ethanol | 0-30 |
| Isopropanol | 0-50 |
| Fumed Silica (CARBOSIL ®) | 0-7 |
| JOY ® Dish Detergent | 0-3 |
| Saffranin | 0-.1 |
| Pace B 82 | 0-5 |
| Methylene Blue | 0-.1 |
| Diethylene Glycol | 0-7 |

CARBOSIL® is a trademark of Polymer Technology Group, Inc. (Berkeley, Calif.) for fumed silica. JOY® is a trademark of The Procter & Gamble Company (Cincinnati, Ohio) for liquid dish washing detergent compositions.

Example 3—Example Adhesive Remover Composition

The following components were mixed to produce an adhesive remover composition: 34 g silica, 25 mL glycerine, a trace amount of methylene blue, 20 mL JOY® liquid dish washing detergent, 400 mL isopropanol, 40 mL methylpropyl ketone, and additional isopropanol or silica to adjust viscosity to be able to apply with airless paint gun.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

The invention claimed is:

1. A method of removing adhesive residue from a substrate comprising the steps of:

a) providing an adhesive remover composition comprising:
   i) a non-halogenated organic solvent selected from the group consisting of a low molecular weight alkyl alcohol, a low molecular weight alkyl ketone, or a combination thereof;
   ii) a non-abrasive thickening agent;
   iii) a surfactant;
   iv) glycerine; and
   v) an absorbable indicator dye;

b) applying said adhesive remover composition to a substrate that has an adhesive residue adhering thereto;

c) permitting a sufficient amount of time to lapse during which said absorbable indicator dye absorbs into or onto said adhesive residue;

d) removing said adhesive remover composition to produce a cleaned substrate; and inspecting said cleaned substrate for the presence of said absorbable indicator dye; wherein the adhesive remover composition has a viscosity of about 500 to about 1000 poise.

2. The method of claim 1 further comprising a step of washing said cleaned substrate with an aqueous solution.

3. The method of claim 1 further comprising a step of washing said cleaned substrate with a non-aqueous solution.

4. The method of claim 1, wherein said substrate is an epoxy graphite composite material.

5. The method of claim 1, wherein said substrate is the exterior surface of an aerospace vehicle.

6. The method of claim 1, wherein said low molecular weight alkyl alcohol is a $C_1$-$C_6$ alcohol.

7. The method of claim 6, wherein said low molecular weight alkyl alcohol is ethanol or isopropanol.

8. The method of claim 1, wherein said low molecular weight alkyl ketone is a $C_3$-$C_8$ ketone.

9. The method of claim 8, wherein said low molecular weight alkyl ketone is methyl propyl ketone or acetone.

10. The method of claim 1, wherein said absorbable indicator dye is methylene blue or a food coloring.

11. The method of claim 1, wherein said non-abrasive thickening agent is silica, cellulose, a cellulose derivative, or a combination thereof.

12. The method of claim 1, wherein said surfactant is a combination of anionic and nonionic surfactants.

13. The method of claim 1, wherein the adhesive remover composition further comprises 2-butoxyethanol or diethylene glycol.

14. The method of claim 1, wherein a 5% by weight suspension of said adhesive remover composition in water has a pH of about 6 to about 8.

15. The method of claim 1, wherein said adhesive remover composition is essentially free of halogenated organic solvents.

16. The method of claim 1, wherein the adhesive remover composition further comprises an additive selected from the group consisting of a buffer, metal complexing agent, emulsifier, perfume, and combinations thereof.

17. The method of claim 1 wherein the adhesive remover composition comprises:

i) organic solvent comprising less than 75% by weight isopropyl alcohol, and less than 20% methylpropyl ketone;
ii) from 5 to 10% amorphous silica;
iii) surfactant
iv) less than 10% glycerine; and
v) less than 1% absorbable indicator dye.

18. The method of claim 1, wherein the step of removing said adhesive remover composition to produce a cleaned substrate comprises:

scraping the adhesive remover composition from the substrate by hand using a scraping tool.

19. The method of claim 1, wherein the step of removing said adhesive remover composition to produce a cleaned substrate comprises:

cleaning the substrate with a non-abrasive scrubbing pad.

* * * * *